US005108546A

United States Patent [19]

Robertson et al.

[11] Patent Number: 5,108,546

[45] Date of Patent: Apr. 28, 1992

[54] BONDED FIBROUS SHEET MATERIAL

[75] Inventors: Diane M. Robertson, West Suffield; Ludmila Byalik, West Hartford; Ronald H. Pomeroy, Windsor Locks, all of Conn.

[73] Assignee: The Dexter Corporation, Windsor Locks, Conn.

[21] Appl. No.: 579,475

[22] Filed: Sep. 10, 1990

[51] Int. Cl.[5] ..... D21H 13/26

[52] U.S. Cl. ..... 162/164.3; 162/164.6; 162/168.1

[58] Field of Search ..... 162/168.1, 164.3, 164.6; 428/34.8

[56] References Cited

U.S. PATENT DOCUMENTS

| | | | |
|---|---|---|---|
| 3,002,881 | 10/1961 | McDonnell | 162/166 |
| 3,484,256 | 12/1969 | Chiu | 162/164.3 |
| 3,640,735 | 2/1972 | Oppenheimer et al. | 138/118.1 |
| 4,461,858 | 7/1984 | Adelman | 524/49 |

*Primary Examiner*—Richard V. Fisher
*Assistant Examiner*—Brenda Lamb
*Attorney, Agent, or Firm*—Chilton, Alix & Van Kirk

[57] ABSTRACT

A bonded fibrous sheet material for use in the manufacture of food casings having fibrous base web containing a 10% weight or less bonding system and the bonding system having a composition which includes polyvinyl alcohol (degree of hydrolysis of greater than 95%).

12 Claims, No Drawings

BONDED FIBROUS SHEET MATERIAL

BACKGROUND AND SUMMARY OF THE INVENTION

The present invention relates generally to casing used for packaging food products such as sausage and the like. More particularly it is concerned with a new and improved binder system used as the bonding agent for fibrous base webs used in making reinforced casing.

Heretofore it has been the practice to make reinforced films, tubing, casings or skins for food products and the like by the encasement of bonded fibrous base papers or substrates in a film forming material. In order to withstand the treatment conditions at the time of encasement, the substrate must be bonded to possess substantial dry strength, wet strength and caustic strength as well as good absorbency. Heretofore substrates of this type have been prepared by bonding a preformed and dried paper or fibrous web with a dilute (1%) viscose solution followed by the steps of drying, regenerating the cellulose, washing and redrying. This bonding operation using the dilute viscose solution was sufficient to impart enough caustic resistance to the bonded substrate to retain its structural integrity during the casing-forming operations where treatment with a more concentrated viscose solution was carried out under highly alkaline conditions. After undergoing bonding the substrate must retain its porous, absorbent characteristics in order to permit adequate impregnation and encasement by the concentrated viscose solution. Typically the casing-forming operation includes the steps of forming the substrate into a cylindrical tube, impregnating and encasing the substrate tube with a highly caustic viscose solution, regenerating the impregnate with acid, washing to remove excess viscose and acid, and drying of the final reinforced film or casing. This process is set forth in greater detail in Underwood U.S. Pat. No. 3,135,613 entitled "Impregnated Paper Webs and Method of Making Sausage Casing Thereof", thus clarifying the sequential evolution of the base web through the bonded substrate phase and then into the reinforced casing.

The tubular casings produced in the manner set forth possess enough strength, dimensional stability and burst resistance to be particularly well suited for enclosing meat and other food products that are injected into the interior of the tubes under pressure. They thereby provide firm uniform enclosures for well known products such as sausage, bologna and the like as well as other food products.

Various patents subsequent to the aforementioned U.S. Pat. No. 3,135,613 have discussed the use of alternative materials for bonding the paper webs to provide appropriate bonded substrates. In selecting bonding materials other than the commercially employed acid-regenerated dilute viscose, it is important that the bonding materials meet both the processing and performance requirements of the food casings to be produced therefrom. Additionally, the fibrous base web to which the bonding agent is to be applied must exhibit sufficient strength to withstand the stresses exerted during both the bonding and coating operations. The amount of bonding agent employed should not interfere with subsequent viscose penetration during the casing manufacturing process such that there is a loss of strength in the casing, or that there is a detrimental effect on the appearance of the casing. Also, the bonding agent should be one which will not cause the substrate to become discolored during exposure to the conditions of the casing forming process. In U.S. Pat. No. 3,484,256 to Chiu et al it is suggested that the dilute viscose bonding treatment be replaced by a bonding agent that consists of a mixture of a cationic thermosetting resin and a polyacrylamide resin. A bonding mixture of a cationic alkaline curing resin and carboxymethyl cellulose has been disclosed by Conway in U.S. Pat. No. 3,468,696 as a substitute wet strength bonding treatment. U.S. Pat. Nos. 3,640,734, 3,640,735 and 3,679,437 to Oppenheimer et al teach the formation of substrates using insolubilized poly(vinyl alcohol) as a wet strength sizing agent while the Jones et al U.S. Pat. No. 4,218,286 teaches the use of a three component binder mixture to obtain improved alkaline wet strength and good absorbency.

The aforementioned binder materials, whether used alone or in combination, frequently provide some of the desired characteristics but not all of those characteristics. For example, the use of poly(vinyl alcohol) having a degree of hydrolysis at about 85% will provide low to moderate levels of dry tensile strength but poor wet tensile, caustic strength and absorption characteristics. Conversely, the use of various film forming materials such as hydroxyethyl cellulose in conjunction with appropriate cross linking agents, such as dialdehyde cross linkers, will have the opposite effect from that achieved by the poly(vinyl alcohol). They exhibit good wet tensile strength and absorption characteristics but relatively poor dry tensile and alkaline strength. Unfortunately, mixtures of these materials also fail to provide all of the desired characteristics.

It is therefore an object of the present invention to provide a new and improved binder system capable of imparting those characteristics heretofore associated with the dilute (1%) viscose bonded material but without the attendant environmental problems associated with the use of viscose. Included in this object is the provision for a binder system that will provide high alkaline strength combined with excellent wet strength and modulus, good absorbency and extensibility, a lack of discoloration when combined with a subsequent viscose treatment and high penetration of the casing forming material into the bonded web. Additionally, the binder material advantageously provides these features in the context of selected binder characteristics that must be employed to achieve the requisite properties on both the bonded paper and the casing.

Other advantages will be in part obvious and in part pointed out more in detail hereinafter.

These and related objects and advantages are obtained by providing a bonded, porous, fibrous sheet material for use in the manufacture of food casings and the like comprising a fibrous base web containing up to about 10% by weight of a specific bonding agent. That agent comprises a solution containing a particular type of thermoplastic poly(vinyl alcohol) and a resin. The system is effective to impart high alkaline or caustic strength to the base web material provided the poly(vinyl alcohol) is both fully hydrolyzed (i.e., at least 98% hydrolyzed) and of high molecular weight (i.e., having a solution viscosity at 4% solids of about 40 centipoises or greater). The ratio of poly (vinyl alcohol) to resin should be greater than 1:1 by weight in order to achieve the appropriate combination of features that include high dry strength and alkaline strength coupled with high wet strength and absorption.

The invention accordingly comprises the several steps and the relation of one or more of such steps with respect to each of the others and the article possessing the features, properties and relation of elements exemplified in the following detail disclosure.

DESCRIPTION OF A PREFERRED EMBODIMENT

According to the present invention the foregoing and related advantages can be achieved by bonding a fibrous base web with a bonding system that consists of a combination of a specific poly (vinyl alcohol) and a cationic resin. This combination imparts to the base web substantial resistance to degradation in the highly caustic casing forming solution yet permits the rapid penetration of that solution into the substrate structure. Additionally, the associated casing manufacturing operations are accomplished in a facile and effective manner without necessitating substantial alterations in the equipment or techniques employed heretofore.

Briefly, the process comprises the steps of forming a dilute suspension of cellulosic fibers, such as manila hemp fibers, and thereafter forming a fibrous base web from the suspension. The base web is dried and then bonded using a bonding solution of a fully hydrolyzed, high molecular weight poly(vinyl alcohol) and certain wet strength resins such as the polymeric reaction product of epichlorohydrin and a polyamide. In this connection it should be noted that frequently the base web materials themselves are bonded by using the same or similar resins as a beater added material as more fully described in the aforementioned U.S. Pat. No. 3,468,696. However, the bonding treatment of the present invention has been found to be most effective when utilized as a post web formation system and to exhibit improved results over viscose bonded substrates using such base webs.

The base web for the casing substrate is generally composed of the natural fibers of pure cellulose and preferably comprises the long, light weight and nonhydrated fibers of the *Musa Textilis* species, typical of which are hemp fibers. Webs made from this material are generally soft, porous papers of uniform texture and thickness and possess tensile strength ratios close to unity, that is, a substantially equal tensile strength in both the machine and transverse or cross direction. However, it will be appreciated that the tensile ratio may vary from about 0.5 to about 1.5 where such is desired.

It is imperative that the bonding agent utilized, namely the poly (vinyl alcohol)/resin system of the present invention, not only imparts to the web a resistance to highly caustic conditions, but also provides no significant interference with the absorption characteristics of the bonded substrate. Preferably the bonding agent should improve the secure adhesion of the casing forming material to the reinforced substrate since it is believed that secure bonding therebetween results in substantial improvement in the burst strength of the resultant casing. At the same time, it should be kept in mind that the web should be devoid, at least as far as possible, of impregnates that might interfere with both the absorption and bonding mechanism. It is therefore necessary that the bonding agent cause as little resistance as possible to the penetration of the casing forming coating into the reinforcing substrate material.

As mentioned, the bonding system of the present invention is a combination or mixture of a specific type of poly(vinyl alcohol) and a resin, preferably a cationic resin curable under acid or alkaline conditions. The resin should preferably provide better physical and chemical stability during the casing forming operation. Additional ingredients such as surfactants and the like may also be included.

The expression "solution of poly(vinyl alcohol)" as used herein is intended to cover solutions of vinyl polymers where the poly(vinyl alcohol) moiety constitutes up to 100% of the vinyl polymer present in the solution. Since poly(vinyl alcohol) is normally prepared by hydrolysis of polyvinyl esters such as poly(vinyl acetate), the degree of substitution or hydrolysis will vary and the hydroxyl content may vary substantially. According to the present invention the desired properties are achieved where hydrolysis levels of the poly(vinyl alcohol) are at least 95% and preferably about 98% or greater. Although various commercial products are available, it has been found that excellent results are obtained when using a fully hydrolyzed (98-99% hydrolysis) aqueous poly(vinyl alcohol) solution or a super hydrolyzed (99+% hydrolysis) solutions.

In addition to being fully hydrolyzed, the poly(vinyl alcohol) must have a high molecular weight. This may be specified as a function of solution viscosity at 4% solids content. Thus, a low to intermediate molecular weight material will have a viscosity in the range of about 2-20 centipoises while a medium weight material will exhibit a viscosity up to about 25-35 centipoises. The material used in the binding system of the present invention should have a high molecular weight exhibiting a viscosity greater than 40 centipoises and typically about 45-70 centipoises. Examples of fully and super hydrolyzed, high molecular weight material include products sold by Air Products Company under the trademarks "Airvol 350" and "Airvol 165".

The concentration of the poly(vinyl alcohol) in the aqueous solution may vary substantially depending on not only the fiber composition of the base web material but also the type of bonding treatment employed and the machine conditions encountered during the treating operation. The concentration of the poly(vinyl alcohol) within its aqueous dispersing medium may be up to 10% by weight but is usually less than 5% by weight and typically falls within the range of from about 1% to 3% by weight. In this connection excellent results have been achieved using a poly(vinyl alcohol) concentration within the range of 1.5% to 2.5% by weight.

The cationic wet strength resins have proved satisfactory from the standpoint of caustic resistance and when combined with the poly(vinyl alcohol) have resulted in strengths for the casings that are comparable to or exceed those obtained by the previously employed dilute viscose bonding treatment. The preferred resinous materials are the uncured thermosetting resins that are acid or alkaline activated and particularly the polymeric reaction products of epichlorodydrin and polyamides containing secondary amine groups. Preferably the epichlorohydrin is used in amounts sufficient to convert the secondary amine groups therein to tertiary amines. Generally polyamides from polyalkylene polyamines and saturated or unsaturated aliphatic or aromatic polycarboxylic acids containing from about three to ten carbon atoms are preferred. A typical example of such a material is the water soluble thermosetting cationic epichlorohydrin-polyamid reaction product sold by Hercules Incorporated of Willmington, Del. under the trade names "Kymene-557H", "Kymene 2064", "Kymene D45" and the like. Other commercially available resins include styrenemaleic anhydride copolymers sold by Monsanto Plastics and Resins Company under the trademark "Scrip- set", and a polyamide-type resin sold by Borden Chemical Division of Borden, Inc. under the trademark "Cascamid C-12".

The amount of resin used in the bonding solution will vary depending on the desired properties. However, it has been found that good results are obtained when the ratio of poly(vinyl alcohol) to resin is at least 1:1 and preferably within the range of about 5:4 to about 4:1. Typically, the amount by weight of resin will exceed 0.2% and preferably falls within the range of 0.5-2.5% by weight with the ratio of poly(vinyl alcohol) to resin being within the range of 3:2 to 3:1. For example, the preferred poly(vinyl alcohol) to resin ratio within the bonding solution is about 2:1.

Generally, it is advantageous to add to the binder solution very small amounts of a surfactant as an absorption aid. In this connection materials such as the nonionic alkylaryl polyethoxy ethanol sold by Rohm and Hass under the trademark "Triton X114" has been effectively used. Other surfactants include nonylphenoxy poly(ethyleneoxy) ethanols, such as the materials sold under the trademark "Igepal" and dodecyl phenoxy poly(ethyleneoxy) ethanols, block copolymers of ethylene oxide and propylene oxide, polyethylene glycol ethers, ethoxylated alkyl phenols and alcohols, alkylaryl polyether alcohols and polyoxyethylene sorbitan monolaurate and monoleate. The surfactants are used in the caustic binder solution at concentrations well below 2.0% by weight and in fact at concentrations of less than 0.5% by weight and preferably less than 0.1% by weight so as to avoid loss of wet strength in the bonded substrate. Typically concentrations of about 0.01% to 0.05% by weight are used. Below this level the water climb characteristics of the substrate are adversely affected.

The preformed fibrous webs, after partial or complete drying, are treated with the bonding solution in accordance with conventional treatment techniques. Excellent results have been obtained utilizing an immersion or dip coating process to obtain the desired impregnation of the web with the bonding solution. The treated web is then dried and used to make the casing.

The coated and dried substrate evidences a binder pickup of about 10% by weight or less, with the amount of binder typically falling within the range of 0.5 to 6% by weight. Best results are achieved when the binder pickup is about 2.0 to 4.5% by weight of the bonded substrate. As mentioned, the bonded substrate not only exhibits improved wet tensile and caustic tensile strength, e.g. caustic tensile strength greater than 300 grams per 25 millimeters, but also retains a high degree of its porous, absorbent character in order to permit impregnation and encasement during the final casing forming operation. Generally the porosity of the bonded substrate can be measured in accordance with TAPPI test method T251-pm-75 and exhibits a Gurley porosity greater than 300 liters /minute. The porosity will vary with the weight of the base web and typically falls within the range of about 500 to 1,500 liters /minute. Lighter sheets will of course have a higher porosity while heavier weight materials exhibit lower porosities. For example, in accordance with the present invention the porosity of the bonded substrate may fall within the range of about 600-1,400 liters/minute. The final casing is made in accordance with conventional casing techniques.

In contrast to a 10% or less pickup of binder by the base web material, the casing forming operation results in not only absorption of the casing forming solution within the substrate but the complete encasement of the substrate by the film forming material. Thus, the relative proportion of the casing film to the substrate on a weight basis is about 1:1 or greater and preferably about 2:I. Thus the resultant casing product is, in effect, a film of the casing forming material reinforced by a bonded fibrous substrate fully embedded therein.

Having generally described the invention, the following examples are include for purpose of illustration so that the invention may be more readily understood, and are in no way intended to limit the scope of the invention unless otherwise specifically indicated. All amounts are on a weight basis unless otherwise specified.

In the series of examples set forth, the standard base fibrous web material consisted of about 100% hemp fiber sheet material having a basis weight of 24.7 grams per square meter and an untreated porosity of 650 liters per minute.

EXAMPLE 1

The standard base web material was dipped into an aqueous solution containing 2% by weight of super hydrolyzed (99.3+hydrolyzed) high molecular weight poly(vinyl alcohol) (Airvol 165), 0.8% by weight of a polymeric reaction product of epichlorohydrin and a polyamide (Kymene 557H) and 0.025% by weight of the surfactant Igepal C0630. The sheet was dried and tested for the properties that are listed in Table 1.

A casing made from the bonded material using viscose as the film forming material exhibited a wet tensile strength in the machine direction of 7315 g/25mm. This compares with a value of 7225 g/25mm for a standard viscose casing using a viscose bonded paper.

EXAMPLE 2

The standard base web was treated as in Example 1, except that the poly(vinyl alcohol) solution contained fully hydrolyzed (98 - 98.8% hydrolyzed) high molecular weight poly(vinyl alcohol) (Airvol 350) (as Example 2A) and low hydrolyzed (87% hydrolyzed) high molecular weight poly(vinyl alcohol)- (Airvol 540) (as Example 2B). The test properties are set forth in Table 1 together with the properties of a viscose bonded material (as Example 2C).

As will be noted the low hydrolyzed material, Example 2B, resulted in poor wet and caustic strength characteristics.

When the poly(vinyl alcohol) employed is fully hydrolyzed but of low molecular weight, (Airvol 107), the wet and caustic strength characteristics are also low, as can be seen from the results of Example 2D in Table 1.

TABLE I

| Example | 1 | 2A | 2B | 2C | 2D |
|---|---|---|---|---|---|
| Basis Wt. (g/sm) | 26.37 | 25.67 | 25.21 | 25.6 | 25.72 |
| Porosity (1/min.) | 750 | 767 | 754 | 847 | 793 |
| Dry Tensile (g/25 mm) | | | | | |
| MD | 4212 | 4925 | 3850 | 5466 | 3162 |
| CD | 3962 | 4075 | 3425 | 3483 | 3000 |

TABLE I-continued

| Example | 1 | 2A | 2B | 2C | 2D |
|---|---|---|---|---|---|
| Dry Elongation (%) | | | | | |
| MD | 3.0 | 2.9 | 2.8 | 2.4 | 2.2 |
| CD | 3.9 | 4.2 | 4.1 | 8.0 | 3.0 |
| Wet Tensile (g/25 mm) | | | | | |
| MD | 1343 | 1392 | 357 | 1433 | 587 |
| CD | 1163 | 1150 | 330 | 1200 | 517 |
| Wet Elongation (%) | | | | | |
| MD | 6.4 | 5.6 | 2.4 | 7.3 | 2.6 |
| CD | 6.6 | 6.7 | 3.3 | 13.8 | 3.4 |
| Caustic Tensile (g/25 mm) | | | | | |
| MD | 1086 | 620 | 157 | 537 | 216 |
| CD | 986 | 552 | 102 | 408 | 222 |
| Water Climb (sec) | | | | | |
| MD | 11.8 | 11.8 | 18.7 | 7.9 | 11.7 |
| CD | 12.1 | 12.4 | 18.6 | 8.9 | 11.6 |
| Casing Wet Tensile (g/25 mm) | 7315 | 6893 | 6080 | 7225 | 6200 |

EXAMPLE 3

Example 1 was repeated except that the amount of poly(vinyl alcohol) was varied from 1.0% to 3.0% in the binder solution. The properties of the bonded web materials are set forth in Table II.

TABLE II

| PVOH (%) | 1.0 | 1.25 | 1.5 | 1.75 | 2.0 | 2.5 | 2.75 | 3.0 |
|---|---|---|---|---|---|---|---|---|
| Basis Weight | 25.74 | 25.75 | 25.88 | 26.02 | 26.37 | 26.23 | 26.36 | 26.47 |
| Dry Tensile | | | | | | | | |
| MD | 3200 | 3566 | 3812 | 4087 | 4212 | 4900 | 4950 | 4737 |
| CD | 2537 | 2716 | 3175 | 3550 | 3962 | 4000 | 4375 | 4375 |
| Dry Elongation | | | | | | | | |
| MD | 2.6 | 3.1 | 2.7 | 3.1 | 3.0 | 3.4 | 3.3 | 3.4 |
| CD | 3.5 | 3.7 | 3.7 | 3.8 | 3.9 | 4.2 | 4.6 | 4.6 |
| Wet Tensile | | | | | | | | |
| MD | 920 | 1050 | 1122 | 1147 | 1343 | 1420 | 1597 | 1592 |
| CD | 832 | 890 | 995 | 1178 | 1163 | 1222 | 1417 | 1537 |
| Wet Elongation | | | | | | | | |
| MD | 5.5 | 5.6 | 5.5 | 5.6 | 6.4 | 7.5 | 7.4 | 7.8 |
| CD | 6.1 | 6.8 | 6.4 | 7.7 | 6.6 | 8.3 | 8.5 | 9.2 |
| Caustic Tensile | | | | | | | | |
| MD | 508 | 580 | 646 | 734 | 1086 | 907 | 780 | 1007 |
| CD | 495 | 590 | 693 | 760 | 986 | 790 | 722 | 1025 |
| Water Climb | | | | | | | | |
| MD | 11.3 | 11.5 | 14.3 | 13.7 | 11.8 | 16.2 | 14.3 | 12.6 |
| CD | 11.4 | 12.5 | 14.9 | 15.6 | 12.1 | 14.3 | 14.6 | 12.5 |

EXAMPLE 4

Example 3 was repeated except that the amount of poly(vinyl alcohol) was kept constant at 2.0% and the amount of alkaline curing agent was varied from 0.4% to 1.5% in the binder solution. The properties of the bonded web materials are set forth in Table III.

TABLE III

| Resin (%) | 0.4 | 0.6 | 0.8 | 1.0 | 1.2 | 1.5 |
|---|---|---|---|---|---|---|
| Basis Weight | 25.70 | 25.74 | 26.37 | 26.15 | 26.18 | 26.32 |
| Porosity | 758 | 753 | 750 | 762 | 795 | 790 |
| Dry Tensile | | | | | | |
| MD | 3816 | 4250 | 4212 | 4150 | 4375 | 4712 |
| CD | 2950 | 3400 | 3962 | 3650 | 3475 | 3887 |
| Dry Elongated | | | | | | |
| MD | 2.9 | 3.3 | 3.0 | 3.1 | 3.4 | 3.3 |
| CD | 3.6 | 4.1 | 3.9 | 4.5 | 4.0 | 4.5 |
| Wet Tensile | | | | | | |
| MD | 920 | 1195 | 1343 | 1315 | 1375 | 1427 |
| CD | 933 | 1095 | 1163 | 1292 | 1225 | 1400 |
| Wet Elongated | | | | | | |
| MD | 5.7 | 6.8 | 6.4 | 6.5 | 6.5 | 6.5 |
| CD | 7.5 | 8.0 | 6.6 | 8.6 | 7.6 | 7.7 |
| Caustic Tensile | | | | | | |
| MD | 688 | 728 | 1086 | 805 | 812 | 852 |
| CD | 633 | 738 | 986 | 745 | 749 | 691 |
| Water Climb | | | | | | |
| MD | 11.4 | 12.0 | 11.8 | 13.9 | 13.6 | 14.5 |
| CD | 11.6 | 12.9 | 12.1 | 14.3 | 14.1 | 15.5 |
| Casing Wet Tensile | 6875 | 7200 | 7315 | 7475 | 7200 | 6750 |

EXAMPLE 5

In order to show the effect of the binding agent on the properties of the final casing, three different binder systems were compared. The bonded web materials were all formed into casings using the same poly(vinyl alcohol) film forming material (Airvol 165) to make the casing. The wet tensile strength of the resultant casings are give below:

| Binder system | Wet Tensile MD | Wet Tensile CD |
|---|---|---|
| Viscose | 5700 | 4100 |
| Low hydrolyzed, low mol. wt. PVOH | 1720 | 1250 |
| Super hydrolyzed, high mol. wt. PVOH | 6250 | 5420 |

As will be apparent to persons skilled in the art, various modifications and adaptations of the process and products described above will become readily apparent without departing from the spirit and scope of the invention.

We claim:

1. A bonded fibrous sheet material for use in the manufacture of food casings comprising a fibrous base web containing about 10% by weight or less of a post web formation bonding system and exhibiting a resistance to degradation under highly caustic conditions while permitting rapid penetration of caustic solutions into the fibrous web structure, said bonding system comprising a poly(vinyl alcohol) having a degree of hydrolysis greater than 95% and a solution viscosity at 4% solids of at least 40 centipoises, said bonded sheet material having a wet tensile strength sufficient to provide structural integrity during casing manufacturing, a caustic tensile strength greater than 300 grams per 25 millimeters and a Gurley porosity greater than 300 liters/minute.

2. The bonded sheet material of claim 1 wherein the poly(vinyl alcohol) has a degree of hydrolysis of at least 98%.

3. The bonded sheet material of claim 1 wherein the poly(vinyl alcohol) has a degree of hydrolysis of at least about 99.3%.

4. The bonded sheet material of claim 1 wherein the poly(vinyl alcohol) solution viscosity falls in the range of about 45–70 centipoises.

5. The bonded sheet material of claim 1 wherein the bonding system includes a cationic resin, the ratio of poly(vinyl alcohol) to resin being greater than 1:1.

6. The bonded sheet material of claim 5 wherein the cationic resin is a polymeric reaction product of epichlorohydrin and a polyamide.

7. The bonded substrate of claim 5 wherein said ratio of poly(vinyl alcohol) to resin falls within the range of 4:1 to 5:4 by weight.

8. The bonded substrate of claim 7 wherein said ratio is about 3:1 to 3:2.

9. The bonded substrate of claim 5 wherein the cationic curing resin is a polymeric reaction product of epichlorohydrin and a polyamide, the bonding system constitutes about 2.0%–4.5% by weight of the substrate and the ratio of poly(vinyl alcohol) to resin falls within the range of 4:1 to 5:4 by weight.

10. The bonded material of claim 1 including a minor amount of a surfactant.

11. The bonded substrate of claim 10 wherein the surfactant comprises less than about 0.1%.

12. The bonded substrate of claim 1 wherein the bonding system constitutes about 0.5%–6.0% by weight of the substrate.

* * * * *